US008551573B2

(12) United States Patent
Eickmeyer et al.

(10) Patent No.: US 8,551,573 B2
(45) Date of Patent: Oct. 8, 2013

(54) METHOD FOR DETERMINING SPRAYING PARAMETERS FOR CONTROLLING A PAINT-SPRAYING APPARATUS USING A SPRAYING AGENT

(75) Inventors: Dietmar Eickmeyer, Friedberg (DE); Gunter Boerner, Sinsheim-Eschelbach (DE)

(73) Assignee: ABB Patent GmbH, Ladenburg (DE)

( * ) Notice: Subject to any disclaimer, the term of this patent is extended or adjusted under 35 U.S.C. 154(b) by 1817 days.

(21) Appl. No.: 11/812,443

(22) Filed: Jun. 19, 2007

(65) Prior Publication Data

US 2007/0289358 A1 Dec. 20, 2007

(30) Foreign Application Priority Data

Jun. 20, 2006 (DE) ..... 10 2006 028 258

(51) Int. Cl.
*B05B 15/04* (2006.01)

(52) U.S. Cl.
USPC ..... 427/421.1; 427/8; 73/1.36

(58) Field of Classification Search
USPC ..... 427/421.1, 8; 73/1.36
See application file for complete search history.

(56) References Cited

U.S. PATENT DOCUMENTS

| | | | | |
|---|---|---|---|---|
| 5,649,063 | A * | 7/1997 | Bose | 706/23 |
| 6,484,121 | B1 | 11/2002 | Filev et al. | |
| 6,494,954 | B1 * | 12/2002 | Bernert et al. | 118/314 |
| 6,507,803 | B1 * | 1/2003 | Eickmeyer et al. | 702/170 |
| 6,745,158 | B1 | 6/2004 | Eickmeyer et al. | |
| 2004/0245354 | A1 * | 12/2004 | Srinivasan | 239/74 |

FOREIGN PATENT DOCUMENTS

| | | | |
|---|---|---|---|
| CA | 2202671 | | 10/1997 |
| DE | 41 36 982 | A1 | 5/1993 |
| DE | 199 36 146 | A1 | 2/2001 |
| DE | 101 34 159 | A1 | 3/2002 |
| DE | 103 07 719 | A1 | 9/2003 |
| DE | 201 22 250 | U1 | 11/2004 |
| DE | 10 2004 046 351 | A1 | 3/2006 |
| DE | 697 31 138 | T2 | 3/2006 |

OTHER PUBLICATIONS

German Search Report dated Mar. 6, 2007 (with English translation of category of cited documents).

* cited by examiner

*Primary Examiner* — Timothy Meeks
*Assistant Examiner* — Nathan T Leong
(74) *Attorney, Agent, or Firm* — Buchanan Ingersoll & Rooney PC

(57) ABSTRACT

A method for determining spraying parameters for controlling a paint-spraying apparatus using a spraying agent is disclosed. A known spray pattern is provided which has been determined by means of known spraying parameters for the use of a first spraying agent. A provisional spray pattern is calculated using the known spraying parameters and the characteristics of a second spraying agent. The known spraying parameters are altered in order to acquire changed spraying parameters which yield a further spray pattern. The changed spraying parameters are altered to the point where the further spray pattern is similar to the known spray pattern within a similarity criterion. The changed spraying parameters corresponding to the further spray pattern are intended as spraying parameters for the second spraying agent and are provided to the paint-spraying apparatus whenever the second spraying agent is used. The spraying parameters comprise a plurality of air currents which influence the spraying behavior of the paint-spraying apparatus.

20 Claims, 3 Drawing Sheets

METHOD FOR DETERMINING SPRAYING PARAMETERS FOR CONTROLLING A PAINT-SPRAYING APPARATUS USING A SPRAYING AGENT

RELATED APPLICATIONS

This application claims priority under 35 U.S.C. §119 to German Application 10 2006 028 258.2 filed in Germany on Jun. 20, 2006, the entire contents of which are hereby incorporated by reference in their entireties.

TECHNICAL FIELD

A method for determining spraying parameters for controlling a paint-spraying apparatus is disclosed, together with a method for controlling the paint-spraying apparatus.

BACKGROUND INFORMATION

Due to a rising complexity of parts to be paint-sprayed, a rising variety of colours and ever shorter product cycles, the demands upon the operators of paint-spraying plants are increasing. Through the conversion of existing paint-spraying plants, on the basis, for example, of robot technology, these demands are able to be met. However, the use of robot technology for paint-spraying plants calls for a relatively high effort in the setting-up of paint-spraying control systems adapted to new paints and/or new component parts of the paint-spraying plant.

From DE 19936146, a method for determining spraying parameters for a paint-spraying apparatus is known.

SUMMARY

One object to be achieved consists in determining spraying parameters for a paint-spraying apparatus which is intended to use a new spraying agent.

A method for determining spraying parameters for controlling a paint-spraying apparatus using a spraying agent is defined, in which, in a first step, a known spray pattern is provided which, by means of known spraying parameters, has been determined for the use of a first spraying agent. In the provision of the known spray pattern and known spraying parameters, a data file containing the appropriate information is able to be interrogated. In a further step, a provisional spray pattern can be calculated using the known spraying parameters and the characteristics of a second spraying agent. The characteristics of the second spraying agent could here comprise the solid content, the viscosity or the surface tension of the second spraying agent. The known spraying parameters can then be altered in order to acquire changed spraying parameters which yield a further spray pattern. The further spray pattern will here generally differ from the known spray pattern, because the changed characteristics of the second spraying agent relative to the first spraying agent result in a different spraying behaviour of the paint-spraying apparatus.

The changed spraying parameters can be altered to the point where the further spray pattern is similar to the known spray pattern within a similarity criterion. The changed spraying parameters corresponding to that further spray pattern which is similar to the known spray pattern can here be intended as spraying parameters for the second spraying agent and provided to the paint-spraying apparatus whenever the second spraying agent is used. This can be realized in the form of the provision of an updated data file containing updated spraying parameters for the paint-spraying apparatus. The spraying parameters, i.e. both the known and the changed spraying parameters, can comprise a plurality of air currents which influence the spraying behaviour of the paint-spraying apparatus.

Examples of spraying agents in general are paints, fixatives or other coating agents which can be atomized by means of an atomizer and in the use of which a particularly even coating thickness distribution onto an object to be coated is demanded.

The first spraying agent in question is a spraying agent for whose use by the paint-spraying apparatus spraying parameters have already been determined, which spraying parameters are accordingly denoted as known spraying parameters.

As the second spraying agent, a spraying agent is denoted whose spraying parameters for controlling the paint-spraying apparatus have yet to be determined. This can be a spraying agent which is used for the first time and which has a different atomization behaviour from the first spraying agent.

As the spray pattern in general, a diagram or a representation is meant which shows a spraying agent distribution on an item, in particular on an object to be paint-sprayed. This item can be defined in the diagram as a two-dimensional background area. The spray pattern can here show two-dimensional or three-dimensional spraying agent distributions. In the three-dimensional representation of the spraying agent distribution, it is revealed how much spraying agent is present at which points on the distribution. This can constitute a snapshot of a spraying agent distribution, the snapshot being able to be perceived as a quasi-stationary spray pattern. In the two-dimensional representation, merely the extent of the spraying agent distribution on the object is shown. The two-dimensional or three-dimensional spray pattern has a width which is defined by the lateral diameter of the spraying agent distribution on the object to be coated. The width is denoted as the spray pattern width. A spray pattern can also be constituted by the representation of a paint-spraying strip, the representation being produced by a plurality of snapshots or quasi-stationary spray patterns of a spraying agent distribution over a certain period being arranged in a line. The width of the paint-spraying strip can then be denoted as the spray pattern width.

A known spray pattern is a spray pattern which has been determined for a first spraying agent having known spraying parameters. The known spraying parameters are here suitable for the use of this first spraying agent and can be used by the paint-spraying apparatus whenever the first spraying agent is used.

By contrast, a provisional spray pattern is a spray pattern which is obtained when the paint-spraying apparatus, in a setting not adapted for a second spraying agent, uses this second spraying agent, for the determination of the provisional spray pattern the known spraying parameters being used which have already been determined for the first spraying agent. The provisional spray pattern will differ from the known spray pattern, since the characteristics of the second spraying agent differ from those of the first spraying agent.

Denoted as the further spray pattern is a spray pattern which is obtained after the known spraying parameters have been altered and the paint-spraying apparatus has been operated with these changed spraying parameters and with the second spraying agent.

A spraying parameter is a parameter which sets the paint-spraying apparatus such that a spray pattern or a coating thickness distribution can be produced. It comprises, in particular, also air currents which influence the shape of the spray cloud leaving the atomizer, ultimately, however, also the spraying agent distribution onto an object to be coated. The air currents are thus suitable for influencing the distribution of the thickness of a coating applied to an object by the paint-spraying apparatus. The values of the air currents can be quoted in liquid quantities per unit of time, e.g. in litres per minute.

Both the provisional and the further spray pattern can be obtained from a simulation which is carried out by a computer equipped with a suitable program product. The spraying parameters are accordingly also modified in the simulation.

The described method for determining spraying parameters for controlling a paint-spraying apparatus has the advantage that the paint-spraying apparatus, which is operated using a plurality of air currents influencing its spraying behaviour, exhibits a spraying behaviour which, through the alteration of the known spraying parameters relating to the air currents, is adapted for the use of the second spraying agent. Thus, the paint-spraying apparatus does not have to be mechanically converted in order to be able to paint-spray in a purposeful manner with a new spraying agent. An existing movement program, which has already been set up, for example, for other spraying agents, can also be used for the paint-spraying apparatus, since the known spray pattern is broadly consistent with the further spray pattern obtained by virtue of the definitively determined spraying parameters.

According to one exemplary embodiment, the paint-spraying apparatus has a high-rotation atomizer, in which deflection air currents, in particular an inner and an outer deflection air current, influence the spraying behaviour of the paint-spraying apparatus. By means of a valve, for example a valve or a valve flap of a metering device, the air currents can be connected as an inner and an outer deflection air current. The deflection air currents can be controlled and regulated independently of each other.

The spraying parameters comprising the air currents, in particular such which relate to inner and outer deflection air settings, can be chosen and iterated as variable values of nested iteration loops.

After each incremental alteration of an air current value in an iteration loop together with other spraying parameters, a further spray pattern is here determined, the similarity of which with the known spray pattern is checked, for the similarity examination the spray pattern width, for example, being used. As soon as a sufficient similarity exists, the appropriate spraying parameters can be stored in a data file and provided to the paint-spraying apparatus in read-off form.

Since, in the case of the nested iteration loops, a multiplicity of spraying parameter combinations, which control the inner and outer deflection air currents, result in a spray pattern which is similar to the known spray pattern within a specific criterion, only those spray patterns can be selected which differ least from the original spraying parameters. In particular, those parameters relating to the inner and outer deflection air currents are chosen which differ least from the corresponding known spraying parameters. This has advantageously the effect that the paint-spraying apparatus or the atomizer is operated about a stable working point. Denoted as a stable working point are those operating points which only have a minor alteration of the parameters during operation, for example, in respect of the spray pattern geometry or spray pattern width, less than 10% of the movement variable (diameter, width). Thus, an alteration of the deflection air current from 300 Nl/min to 310 Nl/min, for example, would still be denoted as a stable working point. Larger changes could possibly jeopardise the production reliability.

According to one exemplary embodiment, a spraying parameter relating to an air current is fixedly coupled to a further spraying parameter. The further spraying parameter can relate, for example, to the quantity of the second spraying agent to be used, or, where a rotary atomizer is used, to the rotation speed of the atomizer. Should merely the inner deflection air current be coupled to the spraying parameters paint quantity or rotation speed, the said iteration loop could be performed with the spraying parameter of the outer deflection air until the desired spray pattern or a desired spray pattern width is achieved. This exemplary embodiment of the method has the advantage that, either in respect of the inner or the outer deflection air current, fewer iteration loops have to be performed, thereby reducing the computing effort.

A fixed functional assignment of the spraying parameter relating to the inner and/or outer deflection air currents to the other spraying parameter can both be of a linear or proportional nature and also be defined via another function or empirical factors.

Irrespective of further spraying parameters, the spraying parameter of the inner deflection air current or that of the outer deflection air current could alternatively perform a fixedly predefined iteration loop which is shorter or traverses fewer values than the iteration loop of the respectively other spraying parameter.

According to a further exemplary embodiment of the method, that discharge quantity of the second spraying agent is calculated which is obtained when the known or the changed spraying parameters are used for the second spraying agent. Should a rotary atomizer be used, the calculated discharge quantity is a criterion for whether the rotation speed of the rotary atomizer is to be increased or reduced. Should an adjustment of the rotation speed be necessary, this is adapted and the alteration of the spraying parameters continued in the simulation.

According to a further exemplary embodiment of the method, the discharge quantity of the second spraying agent is calculated once the desired similarity between the known spray pattern and the further spray pattern has already been achieved. If then the discharge quantity does not lie within a specific tolerance, the rotation speed of the rotary atomizer can be altered and the alteration of the further spraying parameters, in particular those comprising air currents, can be newly begun or continued. This process can be carried out to the point where both the desired similarity between the known spray pattern and the further spray pattern, and the desired spraying agent discharge quantity, is achieved.

A method for controlling a paint-spraying apparatus is also defined, in which the spraying parameters determined according to a method for determining spraying parameters of the described type are used in paint-spraying an object with the second spraying agent.

The second spraying agent can be brought electrostatically onto the object to be coated or paint-sprayed.

BRIEF DESCRIPTION OF THE DRAWINGS

The described methods and items are explained in greater detail with reference to the following figures and illustrative exemplary embodiments, wherein.

DETAILED DESCRIPTION

The movement of a spraying apparatus of a robot-based paint-spraying apparatus generally can remain the same when various spraying agents are used, different characteristics, e.g. solid content or viscosity, of the spraying agent to be used being intended to be taken into account by the desired spraying parameters, for example, paint quantity, deflection air values.

In the adaptation of the known spraying parameters, the basic shape of a spray pattern of an atomizer can be maintained, for instance, even when the paint quantity is altered, so that the overlapping of individual paint-spraying strips, which can be applied to the object to be paint-sprayed, can also remain homogenous.

Figure 1:
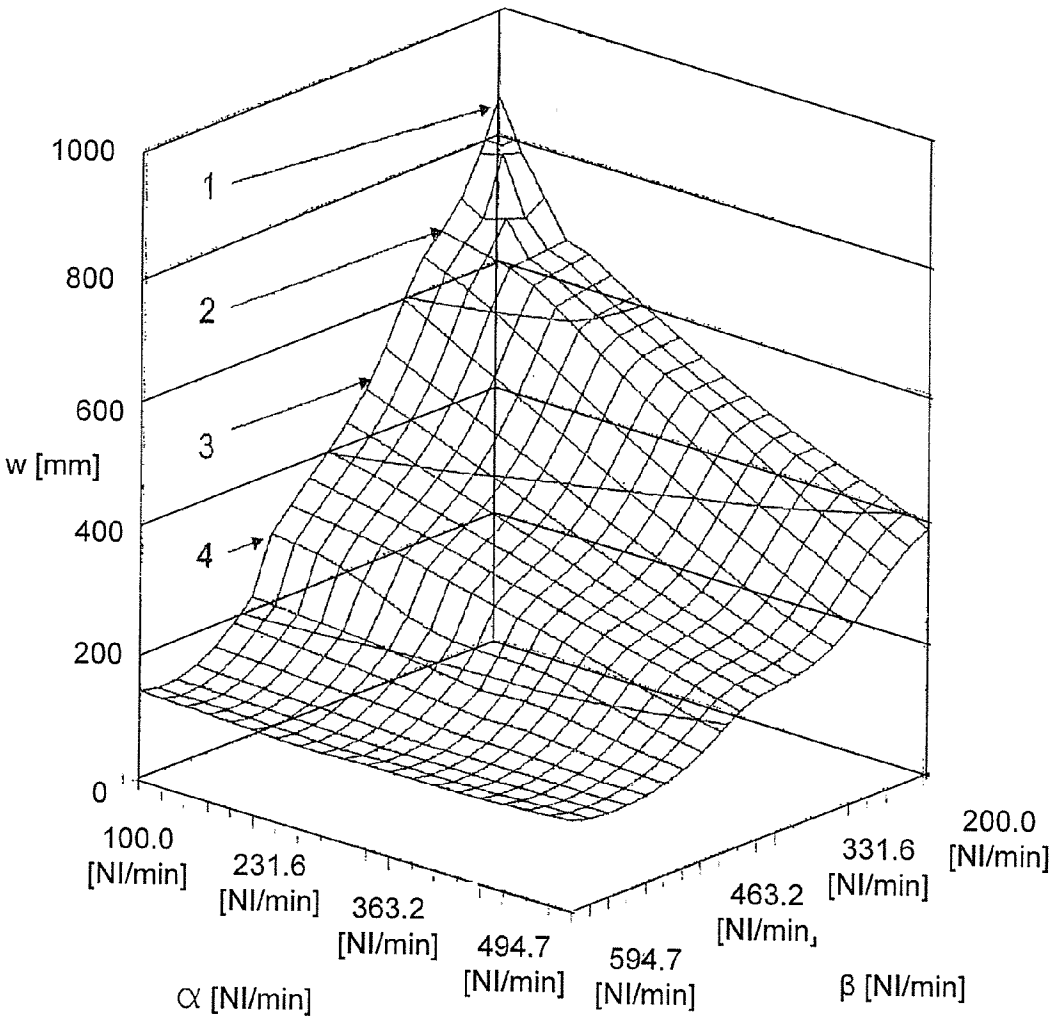
FIG. 1 shows a graphic representation of the dependence of a produced spray pattern width of respectively an outer deflection air current and an inner deflection air current.

FIG. 1 shows the dependence of the width W of a spray pattern (spray pattern width) on values respectively of an outer deflection air current X and an inner deflection air current β, which respectively influence the spray cloud of a paint-spraying apparatus configured with a high-rotation atomizer. The widths W of the spray patterns are here shown with the vertical axis in mm, the outer deflection air current with the bottommost, roughly horizontal axis and the inner deflection air current with the other axis. The deflection air currents are quoted in values of N-litres per minute (Nl/min). The darkly shaded regions 1, 2, 3 in the figure show possible combinations of outer and inner deflection air values which result in specific spray pattern widths, the spray pattern widths, commencing with 1, decreasing. The spray pattern widths in the regions 1, 2 and 3 could approximate to a desired spray pattern width or could be characteristics of such spray patterns which approximate to a known spray pattern. If the parameters of the two air currents are altered, it becomes apparent from the figure that a large number of combinations of these air current values exist, individual ones of which can be selected to form adapted spraying parameters for a new spraying agent.

Basically, if the coating thickness to be obtained is medium and the solid content of the new paint is given, the known spraying parameters, e.g. paint discharge quantity, atomizer air, rotation speed and deflection air current are adapted such that the required medium coating thickness is achieved and the spray patterns or the last produced spray pattern are similar to the corresponding spray patterns of a group reference embracing the known spraying parameters or spray patterns.

When determining spraying parameters for a new paint, the determination of a profiling variable, assuming the other spraying parameters remain constant, in order to obtain a similar spray pattern is an important criterion, whereby the computing effort is kept within limits in the calculation of the desired spraying parameters. As profiling variables with respect to a high-rotation atomizer can in this case be regarded, in particular, the air currents used for deflection or profiling purposes, an inner and an outer deflection air current, in particular, having an impact. The known spraying parameters of the group reference can here be simulated using the characteristics of the new paint and a new, further spray pattern with a changed spray pattern width produced. Subsequently the spray pattern width of the further spray pattern can be gradually increased from a minimum value until this width is greater than that of the corresponding group reference. In rotary atomizers, an increase in spray pattern width can be achieved by a gradual reduction of the inner or outer deflection air current down from its maximum value. A definitive value of the inner or outer deflection air current can be achieved by a linear interpolation of the maximum value.

According to one exemplary embodiment, the gradual alteration of the inner deflection air value can be carried out on the basis of a new spraying agent quantity or on the basis of a rotation speed value of the rotary atomizer, the computing effort arising from the additional variables of the inner and outer deflection air currents being able to be kept within limits.

Alternatively it is possible, on the basis of a new spraying agent quantity or a rotation speed value of the rotary atomizer, to alter the outer deflection air current instead of the inner deflection air current.

Figure 2:
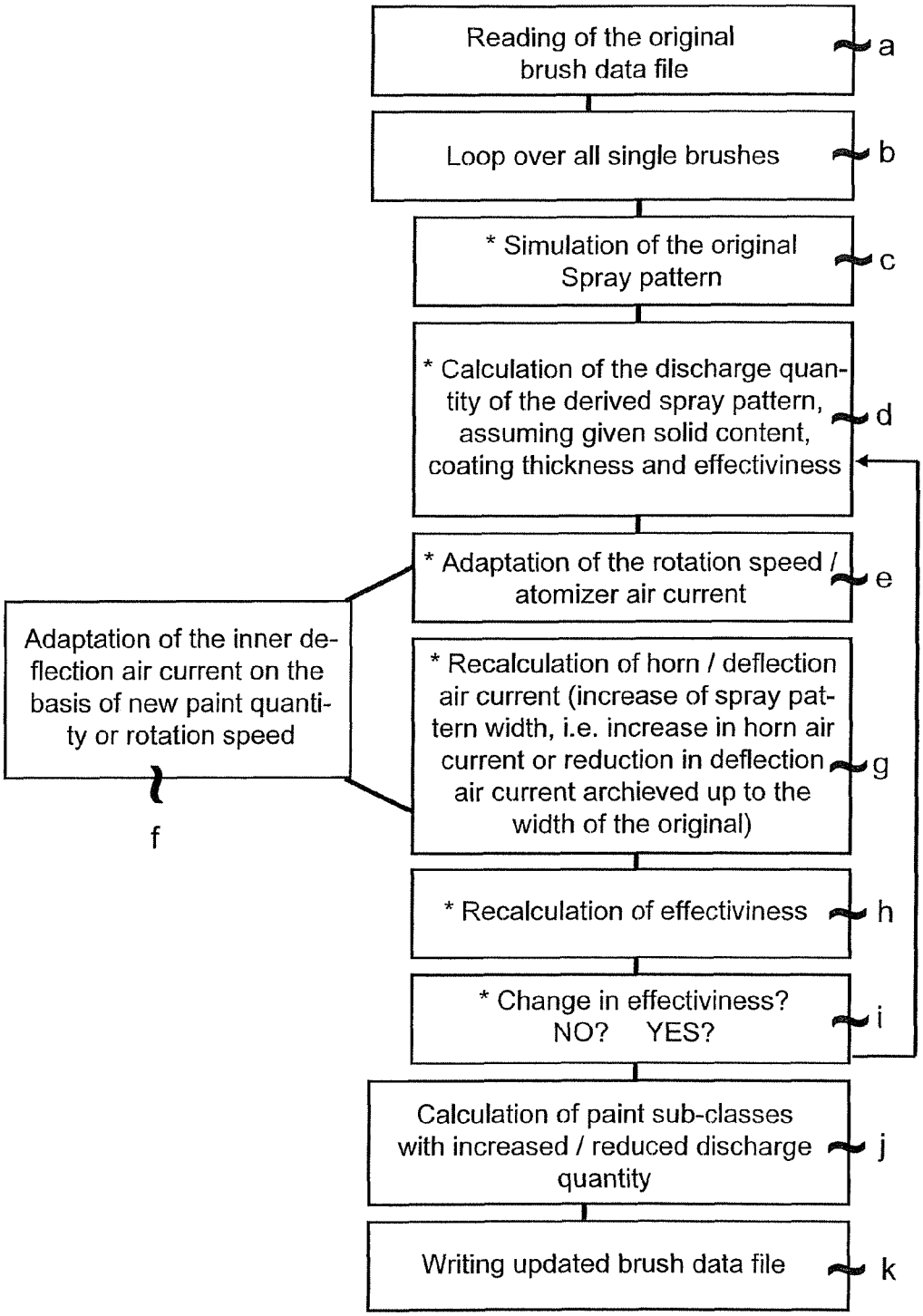
FIG. 2 shows a flow chart in which a plurality of steps for determining desired spraying parameters are defined.

FIG. 2 shows a flow chart in which a number of steps for the determination of spraying parameters are specified. The steps together comprise an automatic calculation of spraying parameters for a new paint from existing spraying parameters for other paints.

In a first step a, known spraying parameters which are present as a data file and in a form readable by the paint-spraying apparatus or paint-spraying robot are provided, which, in combination with given movement instructions available to the paint-spraying apparatus, allow paint-sprayings of a specific object with a specific spraying agent. These known spraying parameters can exist in the form of a so-called brush table and can also be denoted as a group reference, the group reference, in addition to the spraying parameters, also being able to contain information on the type of spray device used, e.g. the atomizer type, on the average coating thickness of the applied paint which is producible by the paint-spraying, and/or on the solid content of the paint. The known spraying parameters yield, moreover, a known spray pattern.

In a second step b, for the known spraying parameter sets (=single brush) of the brush table, the following steps c to k are performed. In the paint-spraying of objects, it is expedient, according to the region to be paint-sprayed, to provide different spray patterns, for example a wide, a thick or thin spray pattern. In this way, diverse parameter sets (=single brush) are produced, which are filed in the robot or its control system in the form of a table.

In a step c, a provisional spray pattern is simulated, which is obtained when the known spraying parameters and the information regarding the characteristics of the new paint are combined.

In a step d, the discharge quantity of the new paint is calculated, which is obtained when the known spraying parameters are used for the new paint. It is determined whether the discharge quantity lies within an acceptable quantity frame or not.

Should the discharge quantity not lie within an acceptable frame or not be suitable for the attainment of a medium paint coating layer, in a step e the rotation speed of the high-rotation atomizer used by the paint-spraying apparatus can be altered in the simulation in order to set the discharge quantity of the new paint to a desired quantity.

With further steps g and f, such spraying parameters which influence the deflection air currents of the high-rotation atomizer are altered in order to achieve a desired spray pattern or the desired spray pattern width. In particular, the outer deflection air current can be altered in the simulation, shown with step g, until a desired spray pattern width is achieved.

Where the outer deflection air current is thus altered until the desired spray pattern width is achieved, the inner deflection air current can be altered coupled to the change of the rotation speed of the high-rotation atomizer or the change of the paint discharge quantity in step e. The coupling of the spraying parameter of the inner deflection air current with that of the rotation speed or of the paint discharge quantity is shown with block f. Thus the number of changes to one spraying parameter, namely that of the inner deflection air current, is reduced and the effort involved in the calculation of adapted spraying parameters for the new paint is lessened.

Alternatively, it is possible to alter in step g the inner deflection air current instead of the outer deflection air current, until the desired spray pattern width has been achieved in the simulation. Accordingly, an alteration of the outer deflection air current could here be coupled to the change of the rotation speed or paint discharge quantity (block f), in order, as described above, to reduce the computing effort.

In a step h, the effectiveness of the calculated spraying behaviour of the paint-spraying apparatus can be calculated. Here it is determined how much paint is used to produce a specific paint coating thickness in a specific quality.

If the effectiveness has altered relative to such spray patterns which have already been determined for other paints with known spraying parameters, the computing operation begins anew with step d, where the discharge quantity is calculated and can subsequently be altered by means of a change of rotation speed of the high-rotation atomizer. The finding regarding a change of effectiveness is shown with block i.

In a step j, paint sub-classes with increased or reduced discharge quantity of the new paint or second spraying agent tested in the simulation can be calculated. For the paint sub-classes, the described steps or loops can be performed anew and corresponding spraying parameters determined.

In a step k, a new brush table with the spraying parameters adapted for the second spraying agent can be written and made available to the paint-spraying apparatus.

Basically, nested iteration loops for inner and outer deflection air values can be performed, the resulting points of intersection which yield a similar spray pattern to the spray pattern obtained from the known spraying parameters, being stored in a date file.

After the iteration loops have been performed, the inner and the outer loops being able to be dependent on further spraying parameters, e.g. paint quantity and rotation speed of the rotary atomizer, the effectiveness of the new spraying parameters is calculated. Given a sufficient effectiveness, i.e. given a sufficient similarity with a spray pattern known for other paints, an updated brush table can be written and made available to the paint-spraying apparatus. If the effectiveness is insufficient, the known spraying parameters can once again be adapted to the desired spraying parameters, in particular using the parameters of the inner and the outer deflection air currents, until a sufficient similarity with a spray pattern known for other paints is achieved.

Figure 3:
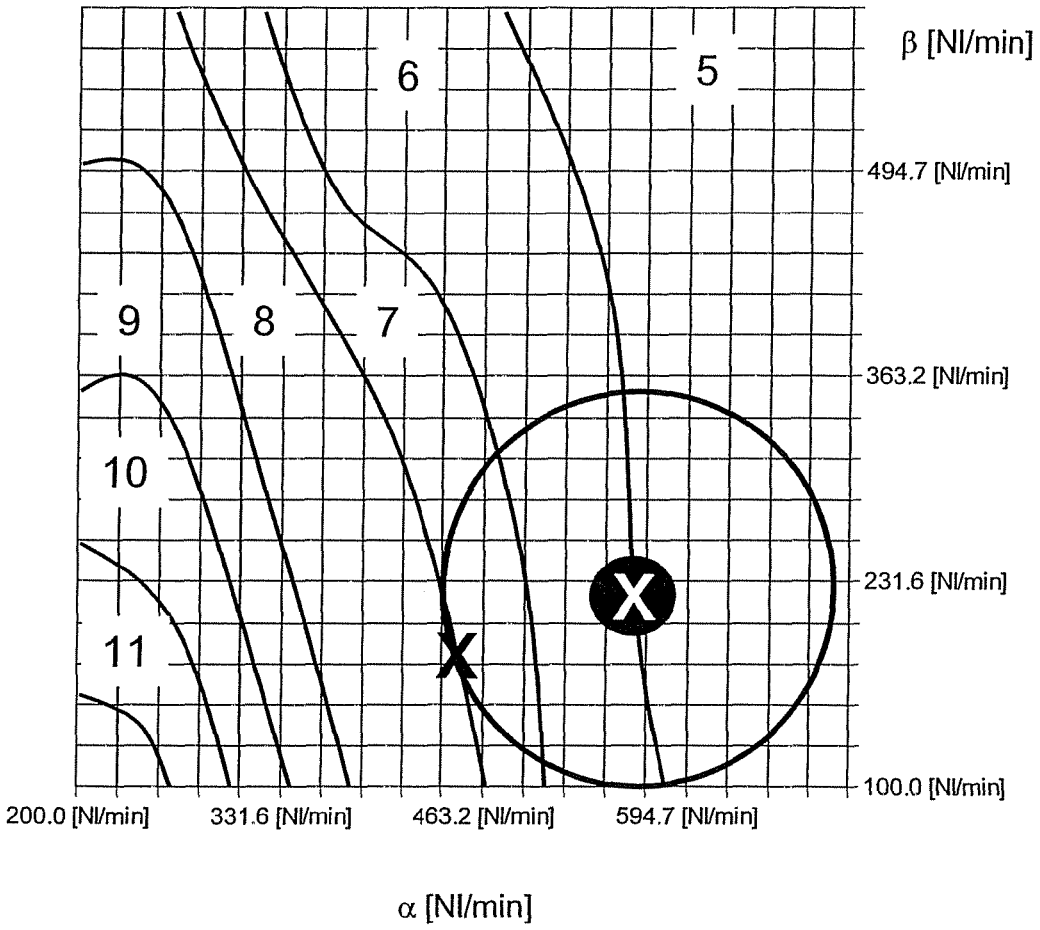
FIG. 3 shows a graphic representation of a plurality of classes containing areas of deflection air combinations, in one class a deflection air combination being chosen which approximates to a deflection air combination of a known class.

FIG. 3 defines a graphic representation of a number of deflection air classes 5 to 10. Each deflection air class embraces an area which corresponds to the sum of a multiplicity of inner and outer deflection air combinations or coordinates (X, β). The deflection air combinations of one class here result in a specific spray pattern width. Outer deflection air values are shown with X in Nl/min, inner deflection air values with β (Nl/min).

The largest coherent area in the figure is the known deflection air class 5, which defines an area or sum of deflection air combinations which, for a known paint, result in a known spray pattern with a specific spray pattern width. Lying closest to the known deflection air class 5 is a deflection air class 6, which is characterized by an area of deflection air combinations which have been obtained, using the described method for determining spraying parameters, as spraying parameters for a new paint. This new deflection air class 6 has a marginal region 6*a*, which is formed by deflection air combinations which are most approximate to the deflection air value combinations of the known deflection air class 5. As a proximity criterion, root mean squares are in this case preferably used, which define a specific proximity between a region of a newly calculated deflection air class and the known deflection air class. It is calculated which point in the deflection air class 6 lies nearest to a selectable point, shown with a white "X", within the known deflection air class 5. The located point is shown with a black "X" and has a distance to the white "X" which corresponds to the radius of the circle shown in the figure. The black "X" here defines an outer deflection air value X of about 436 Nl/min and an inner deflection air value β of about 240 Nl/min. By contrast, the white "X" according to the known spraying parameters corresponds to an inner deflection air value of about 280 Nl/min and an outer deflection air value of about 570 Nl/min.

The selection of specific deflection air currents, used as spraying parameters, for a new spraying agent by means of the above-described method has the advantage that, in addition to the similarity criterion between a known spray pattern and a further spray pattern or their widths, a further criterion exists, with which a single or at least a small number of few deflection air value combinations can be chosen. With these few deflection air value combinations, the paint-spraying apparatus can be operated for the new or the second spraying agent and a spray pattern or a coating thickness distribution onto an object to be coated can be produced which corresponds to the previous, known coating thickness distribution for known paints and known spraying parameters. A costly conversion of a paint-spraying apparatus due to the use of a new paint can hence be fully relinquished, or at least reduced.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SYMBOL LIST

1 to 4 various spray pattern widths
5 first deflection air class
6 next deflection air class
6*a* marginal region of the next deflection air class
7 to 10 further deflection air classes
a provision of known spraying parameters
b loop over all single brushes
c simulation of a provisional spray pattern
d calculation of the discharge quantity of the second spraying agent
e adaptation of the rotation speed of a high-rotation atomizer
f coupling of a deflection air parameter to a further spraying parameter
g alteration of another deflection air parameter
h effectiveness calculation
i finding regarding the change of effectiveness
j calculation of paint sub-classes with increased or reduced discharge quantity
k provision of an updated brush table with updated spraying parameters
X outer deflection air value
β inner deflection air value

What is claimed:

1. A method for determining spraying parameters for controlling a paint-spraying apparatus using a spraying agent, the method comprising:

providing a known spray pattern of which spraying parameters using a first spraying agent has been known, simulating a provisional spray pattern by a computing means based on the known spraying parameters and the characteristics of a second spraying agent, iteratively altering by the computing means the known spraying parameters in order to acquire changed spraying parameters which yield a further spray pattern, altering the changed spraying parameters to the point where the further spray pattern is similar to the known spray pattern within a similarity criterion, and providing the changed spraying parameters corresponding to the further spray pattern as spraying parameters for the second spraying agent to the paint-spraying apparatus when the second spraying agent is used, wherein the spraying parameters comprise a plurality of air currents which influence the spraying behaviour of the paint-spraying apparatus.

2. Method according to claim 1, wherein the paint-spraying apparatus has at least one high-rotation atomizer, the spraying behaviour of which is influenced by an inner and an outer deflection air current and the deflection air currents are used as variable spraying parameters.

3. Method according to claim 2, in which the spraying parameters of the inner deflection air and the outer deflection air currents are chosen as the variable values (x, β) of nested iteration loops and are iterated.

4. Method according to claim 2, in which the rotation speed of the high-rotation atomizer is used as a spraying parameter.

5. Method according to claim 4, in which the spraying parameter of the inner deflection air current is fixedly coupled to the spraying parameter of the rotation speed of the high-rotation atomizer.

6. Method according to claim 4, in which the discharge quantity of the second spraying agent is calculated, the spraying parameter of the rotation speed being altered in dependence on the calculated discharge quantity of the second spraying agent.

7. Method according to claim 4, in which the spraying parameter of the outer deflection air current is fixedly coupled to the spraying parameter of the rotation speed of the high-rotation atomizer.

8. Method according to claim 7, in which the spraying parameter of an air current is coupled at least to a further spraying parameter by means of a functional assignment.

9. Method according to claim 1, in which the spraying parameter of an air current is coupled at least to a further spraying parameter by means of a functional assignment.

10. Method according to claim 9, in which the similarity criterion comprises a comparison of the spray pattern width of the known spray pattern with the spray pattern width of the further spray pattern.

11. Method according to claim 1, in which the similarity criterion comprises a comparison of the spray pattern width of the known spray pattern with the spray pattern width of the further spray pattern.

12. Method according to claim 11, in which, for providing for the paint-spraying apparatus, air currents are chosen which differ least from the spraying parameters known for the first spraying agent.

13. Method according to claim 1, in which, for providing for the paint-spraying apparatus, air currents are chosen which differ least from the spraying parameters known for the first spraying agent.

14. Method according to claim 13, in which the air currents chosen as spraying parameters have, in terms of the root mean square, the least deviations relative to the spraying parameters known for the first spraying agent.

15. Method for controlling a paint-spraying apparatus, in which a method for determining spraying parameters according to claim 14 is used.

16. Method for controlling a paint-spraying apparatus, in which a method for determining spraying parameters according to claim 1 is used.

17. Method according to claim 16, in which the spraying behaviour of the atomizer is influenced by the air currents used as spraying parameters.

18. A method according to claim 1, wherein the altering of the changed spraying parameters takes paint discharge quantity, and movement of the paint-spraying apparatus, into consideration.

19. A method for determining spraying parameters for controlling a spraying apparatus using a spraying agent, comprising:

providing a determined spray pattern of known spraying parameters for a first spraying agent, calculating by a computing means a provisional spray pattern using the known spraying parameters and the characteristics of a second spraying agent, altering the known spraying parameters to change the spraying parameters to result in a resulting spray pattern, the spraying parameters being adaptively changed until the resulting spray pattern becomes sufficiently similar to the known spray pattern within a similarity criterion, and providing the adaptively changed spraying parameters to the spraying apparatus as the intended spraying parameters for use with the second spraying agent.

20. A method according to claim 19, wherein the altering of the changed spraying parameters takes paint discharge quantity, and movement of the paint-spraying apparatus, into consideration.

* * * * *